US008781380B2

(12) United States Patent
Tsukawaki

(10) Patent No.: US 8,781,380 B2
(45) Date of Patent: Jul. 15, 2014

(54) FIXING DEVICE

(75) Inventor: Hisashi Tsukawaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 8 days.

(21) Appl. No.: 13/334,157

(22) Filed: Dec. 22, 2011

(65) Prior Publication Data

US 2012/0163883 A1 Jun. 28, 2012

(30) Foreign Application Priority Data

Dec. 24, 2010 (JP) ..... 2010-287377

(51) Int. Cl.
*G03G 15/20* (2006.01)

(52) U.S. Cl.
USPC ..... 399/329; 399/328

(58) Field of Classification Search
USPC ..... 399/329
See application file for complete search history.

(56) References Cited

U.S. PATENT DOCUMENTS

| | | | |
|---|---|---|---|
| 4,187,033 | A | 2/1980 | Zukowski |
| 6,456,818 | B1 | 9/2002 | Nakayama et al. |
| 6,501,935 | B2 | 12/2002 | Hirai et al. |
| 6,830,212 | B1 | 12/2004 | Harris |
| 7,242,895 | B2 | 7/2007 | Inada et al. |
| 7,283,780 | B2 | 10/2007 | Uchida et al. |
| 7,359,666 | B2 | 4/2008 | Takashi et al. |
| 7,593,678 | B2 | 9/2009 | Suenaga |
| 7,664,448 | B2 | 2/2010 | Lee et al. |
| 7,881,650 | B2 | 2/2011 | Shin et al. |
| 7,965,970 | B2 | 6/2011 | Haseba et al. |
| 8,032,069 | B2 | 10/2011 | Shin et al. |
| 8,131,197 | B2 | 3/2012 | Hiraoka et al. |
| 2001/0022909 | A1 * | 9/2001 | Takeuchi et al. ..... 399/328 |
| 2002/0018676 | A1 | 2/2002 | Hirai et al. |
| 2002/0039504 | A1 | 4/2002 | Nakayama et al. |

(Continued)

FOREIGN PATENT DOCUMENTS

| | | | |
|---|---|---|---|
| CN | 101261481 | A | 9/2008 |
| CN | 101846944 | A | 9/2010 |

(Continued)

OTHER PUBLICATIONS

Extended EP Search Report mailed May 3, 2012, EP Appln. 11192796.8-2216.

(Continued)

*Primary Examiner* — Clayton E Laballe
*Assistant Examiner* — Jas Sanghera
(74) *Attorney, Agent, or Firm* — Banner & Witcoff, Ltd.

(57) ABSTRACT

A fixing device includes: a tubular member having an outer peripheral surface, an inner peripheral surface defining an internal space, and an axis defining an axial direction, the tubular member being configured to move around the axis; a heater disposed in an internal space to radiate heat; a nip member that contacts the inner peripheral surface to transmit the heat to the tubular member; a backup member that is in contact with the outer peripheral surface to form a nip region between the backup member and the tubular member, the backup member applying a load to the nip member; and a stay disposed in the internal space to support the nip member against the load. The nip member includes: a first member that contacts the inner peripheral surface; and a second member disposed between the first member and the stay to transmit the load to the stay.

6 Claims, 5 Drawing Sheets

(56) References Cited

U.S. PATENT DOCUMENTS

| | | | | |
|---|---|---|---|---|
| 2003/0185604 | A1 | 10/2003 | Sato | |
| 2005/0185994 | A1 | 8/2005 | Inada et al. | |
| 2005/0191097 | A1 | 9/2005 | Yoshida et al. | |
| 2007/0059001 | A1 | 3/2007 | Matsuura et al. | |
| 2007/0059022 | A1 | 3/2007 | Yamaoka et al. | |
| 2007/0212135 | A1 | 9/2007 | Suenaga | |
| 2008/0112739 | A1* | 5/2008 | Shinshi | 399/329 |
| 2008/0124147 | A1 | 5/2008 | Uehara et al. | |
| 2008/0219723 | A1 | 9/2008 | Lee et al. | |
| 2008/0292374 | A1 | 11/2008 | Hiraoka et al. | |
| 2009/0047047 | A1 | 2/2009 | Ardery et al. | |
| 2009/0080954 | A1 | 3/2009 | Miyata et al. | |
| 2009/0092423 | A1* | 4/2009 | Shin et al. | 399/329 |
| 2009/0208264 | A1 | 8/2009 | Fujiwara et al. | |
| 2010/0202809 | A1 | 8/2010 | Shinshi et al. | |
| 2010/0247183 | A1 | 9/2010 | Haseba et al. | |
| 2011/0091254 | A1 | 4/2011 | Shin et al. | |
| 2011/0129267 | A1 | 6/2011 | Arimoto et al. | |
| 2011/0170917 | A1* | 7/2011 | Yoshikawa et al. | 399/329 |
| 2012/0093548 | A1 | 4/2012 | Kimura | |

FOREIGN PATENT DOCUMENTS

| | | | |
|---|---|---|---|
| JP | H04-122969 | A | 4/1992 |
| JP | 05-341685 | A | 12/1993 |
| JP | 06-118823 | A | 4/1994 |
| JP | 06-282183 | | 10/1994 |
| JP | 08-248791 | | 9/1996 |
| JP | 10-268681 | A | 10/1998 |
| JP | 10-340017 | | 12/1998 |
| JP | 2000-330417 | | 11/2000 |
| JP | 2002-123107 | A | 4/2002 |
| JP | 2003-316181 | | 11/2003 |
| JP | 2004-198556 | A | 7/2004 |
| JP | 2005-010201 | | 1/2005 |
| JP | 2005-234294 | A | 9/2005 |
| JP | 2007-017772 | | 1/2007 |
| JP | 2007-279665 | A | 10/2007 |
| JP | 2008-224878 | A | 9/2008 |
| JP | 2008-233886 | | 10/2008 |
| JP | 2008-292793 | A | 12/2008 |
| JP | 2009-093141 | A | 4/2009 |
| JP | 2009-237089 | | 10/2009 |

OTHER PUBLICATIONS

Co-pending U.S. Appl. No. 13/334,170, filed Dec. 22, 2011.
Co-pending U.S. Appl. No. 13/334,165, filed Dec. 22, 2011.
Co-pending U.S. Appl. No. 13/334,183, filed Dec. 22, 2011.
JP Office Action mailed Jan. 22, 2013, JP Appln. 2010-288620, English Translation.
JP Office Action mailed Jan. 15, 2013, JP Appln. 2010-287935, English Translation.
JP Office Action mailed Jan. 15, 2013, JP Appln. 2010-287377, English Translation.
JP Office Action mailed Jan. 15, 2013, JP Appln. 2010-287371, English Translation.
Non-final Office Action received in U.S. Appl. No. 13/334,165 mailed Sep. 4, 2013.
Non-final Office Action received in U.S. Appl. No. 13/334,170 mailed Jul. 11, 2013.
English Translation JP2004-198556 dated Jul. 11, 2013.
Non-Final Office Action issued in U.S. Appl. No. 13/334,183 mailed Dec. 4, 2013.
Machine translation of JP06-118823. Published in 1994, Translated on Dec. 3, 2013.
CN First Office Action mailed Jan. 21, 2014, CN appln. 201110441042.5, English Translation.
Notice of Allowance issued in corresponding U.S. Appl. No. 13/334,165, mailed Jan. 30, 2014.
Notice of Allowance issued in corresponding U.S. Appl. No. 13/334,183 mailed Mar. 13, 2014.
Final Office Action received in U.S. Appl. No. 13/334,170 mailed Apr. 9, 2014.

* cited by examiner

FIXING DEVICE

CROSS REFERENCE TO RELATED APPLICATION

This application claims priority from Japanese Patent Application No. 2010-287377 filed Dec. 24, 2010. The entire content of the priority application is incorporated herein by reference.

TECHNICAL FIELD

The present invention relates to a fixing device that thermally fixes a developing agent image transferred on a sheet.

BACKGROUND

A conventional fixing device includes an endless fusing film, a heater disposed in an internal space of the fusing film, a nip member defining a nip portion relative to a pressure roller through the fusing film, and a reflection plate for reflecting radiant heat radiated from the heater to the nip member. The above fixing device thermally fixes a developing agent image transferred on a sheet fed between the fusing film and the pressure roller.

SUMMARY

It is an object of the invention to provide a fixing device capable of raising a temperature of the nip member to a predetermined fixing temperature in a short time.

In order to attain the above and other objects, the present invention provides a fixing device a fixing device including: a flexible tubular member having an outer peripheral surface, an inner peripheral surface defining an internal space, and an axis defining an axial direction, the tubular member being configured to circularly move in a rotational direction around the axis; a heater disposed in the internal space to radiate a radiant heat; a nip member that is in contact with the inner peripheral surface to transmit the radiant heat to the tubular member; a backup member that is in contact with the outer peripheral surface to form a nip region between the backup member and the tubular member, the backup member applying a load to the nip member; and a stay disposed in the internal space to support the nip member against the load. The nip member includes: a first member that is in contact with the inner peripheral surface; and a second member disposed between the first member and the stay to transmit the load to the stay. The first member has a heat conductivity higher than the second member. The second member is formed with an opening for transmitting the radiant heat to the first member.

DETAILED DESCRIPTION

Figure 1:
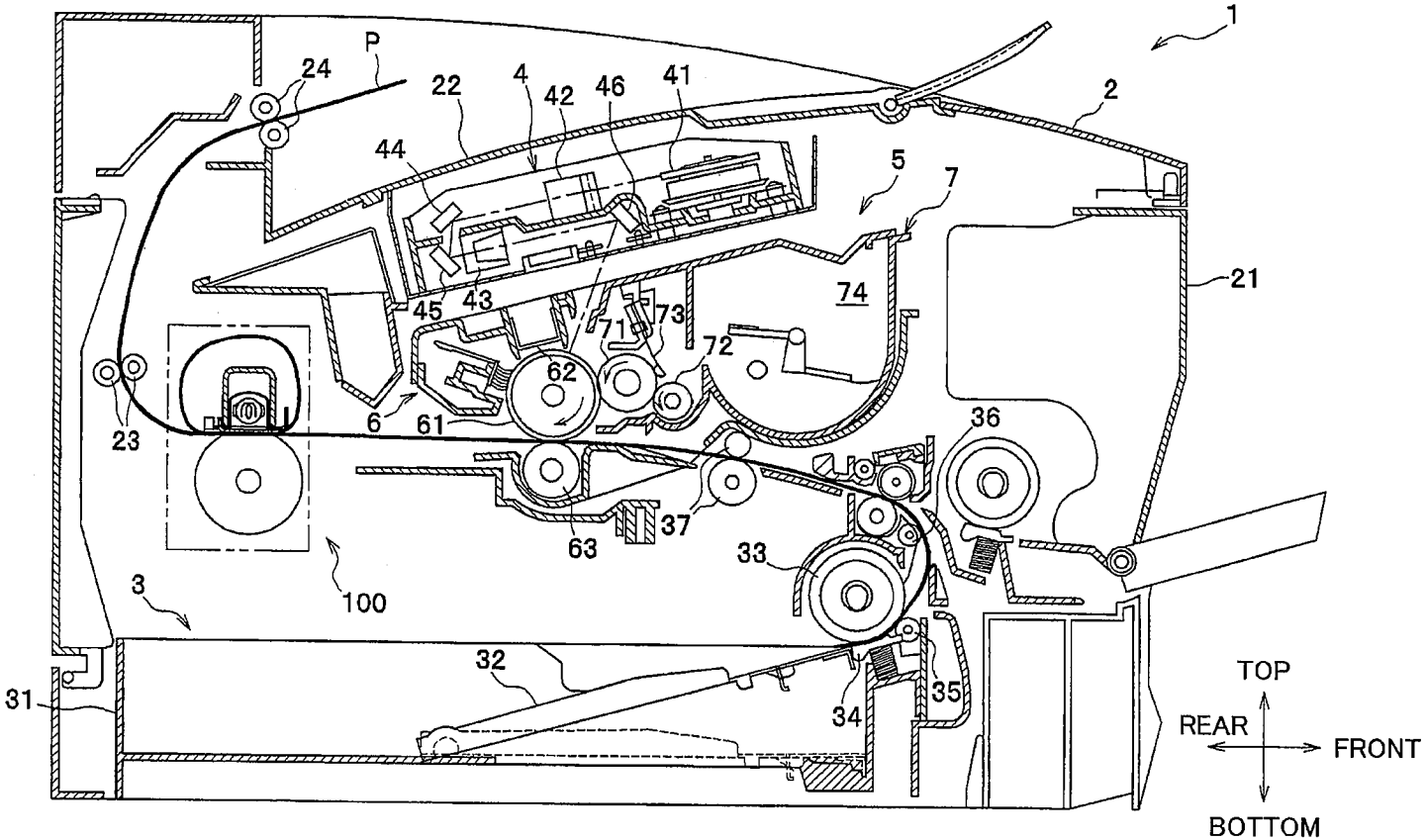
FIG. 1 is a schematic cross-sectional view showing a structure of a laser printer having a fixing device according to one embodiment of the present invention.

Next, a general structure of a fixing device according to one embodiment of the present invention will be described with references. A laser printer 1 shown in FIG. 1 is provided with a fixing device 100 according to the embodiment of the present invention. A detailed structure of the fixing device 100 will be described later.

<General Structure of Laser Printer>

As shown in FIG. 1, the laser printer 1 includes a main frame 2 with a movable front cover 21. Within the main frame 2, a sheet supply unit 3 for supplying a sheet P, an exposure unit 4, a process cartridge 5 for transferring a toner image (a developing agent image) on the sheet P, and the fixing device 100 for thermally fixing the toner image onto the sheet P are provided.

Throughout the specification, the terms "above", "below", "right", "left", "front", "rear" and the like will be used assuming that the laser printer 1 is disposed in an orientation in which it is intended to be used. More specifically, in FIG. 1, a left side and a right side are a rear side and a front side, respectively.

The sheet supply unit 3 is disposed at a lower portion of the main frame 2. The sheet supply unit 3 includes a sheet supply tray 31 for accommodating the sheet P, a lifter plate 32 for lifting up a front side of the sheet P, a sheet supply roller 33, a sheet supply pad 34, paper dust removing rollers 35, 36, and registration rollers 37. Each sheet P accommodated in the sheet supply tray 31 is directed upward to the sheet supply roller 33 by the lifter plate 32, separated by the sheet supply roller 33 and the sheet supply pad 34, and conveyed toward the process cartridge 5 passing through the paper dust removing rollers 35, 36, and the registration rollers 37.

The exposure unit 4 is disposed at an upper portion of the main frame 2. The exposure unit 4 includes a laser emission unit (not shown), a polygon mirror 41, lenses 42, 43, and reflection mirrors 44, 45, 46. In the exposure unit 4, the laser emission unit is adapted to project a laser beam (indicated by a dotted line in FIG. 1) based on image data so that the laser beam is deflected by or passes through the polygon mirror 41, the lens 42, the reflection mirrors 44, 45, the lens 43, and the reflection mirror 46 in this order. A surface of a photosensitive drum 61 is subjected to high speed scan of the laser beam.

The process cartridge 5 is disposed below the exposure unit 4. The process cartridge 5 is detachable or attachable relative to the main frame 2 through a front opening defined by the front cover 21 at an open position. The process cartridge 5 includes a drum unit 6 and a developing unit 7.

The drum unit 6 includes the photosensitive drum 61, a charger 62, and a transfer roller 63. The developing unit 7 is detachably mounted to the drum unit 6. The developing unit 7 includes a developing roller 71, a toner supply roller 72, a regulation blade 73, and a toner accommodating portion 74 in which toner (developing agent) is accommodated.

In the process cartridge 5, after the surface of the photosensitive drum 61 has been uniformly charged by the charger 62, the surface is subjected to high speed scan of the laser beam from the exposure unit 4. An electrostatic latent image based on the image data is thereby formed on the surface of the photosensitive drum 61. The toner accommodated in the toner accommodating portion 74 is supplied to the developing roller 71 via the toner supply roller 72. The toner is conveyed between the developing roller 71 and the regulation blade 73 so as to be deposited on the developing roller 71 as a thin layer having a uniform thickness.

The toner deposited on the developing roller 71 is supplied to the electrostatic latent image formed on the photosensitive drum 61. Hence, a visible toner image corresponding to the electrostatic latent image is formed on the photosensitive drum 61. Then, the sheet P is conveyed between the photosensitive drum 61 and the transfer roller 63, so that the toner image formed on the photosensitive drum 61 is transferred onto the sheet P.

The fixing device 100 is disposed rearward of the process cartridge 5. The toner image (toner) transferred onto the sheet P is thermally fixed on the sheet P while the sheet P passes through the fixing device 100. The sheet P on which the toner image is thermally fixed is conveyed by conveying rollers 23 and 24 so as to be discharged on a discharge tray 22.

<Detailed Structure of Fixing Device>

Figure 2:
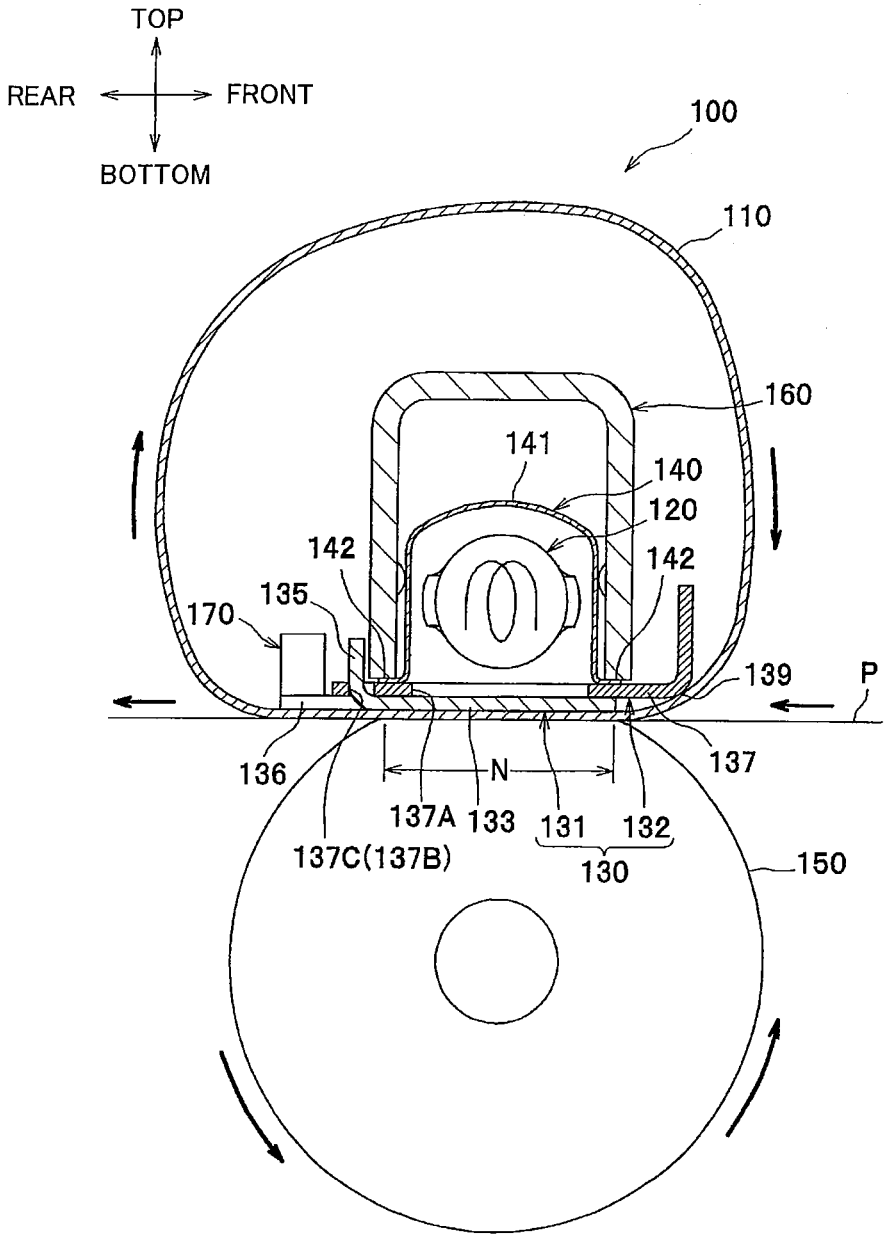
FIG. 2 is a schematic cross-sectional view showing a structure of the fixing device according to the embodiment.
Figure 3:
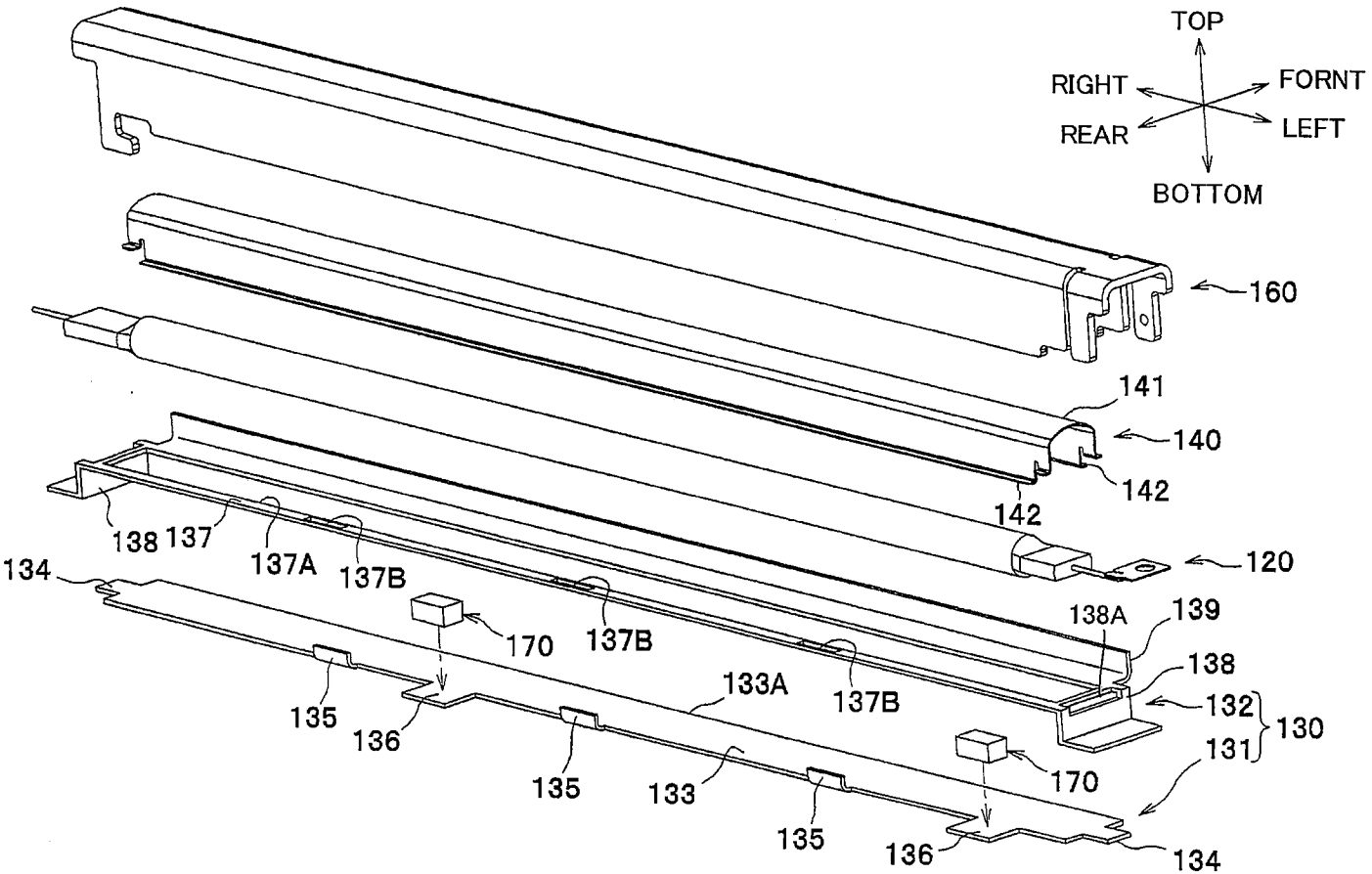
FIG. 3 is an exploded perspective view showing a halogen lamp, a nip member, a reflection plate, and a stay.

As shown in FIG. 2, the fixing device 100 includes a fusing film 110, a halogen lamp 120, a nip member 130, a reflection plate 140, a pressure roller 150, a stay 160, and two thermistors 170 (FIG. 3).

The fusing film 110 has an endless (tubular) configuration having heat resistivity and flexibility. Each end portion of the fusing film 110 in an axis direction (left to right direction in FIG. 2) is guided by a guide member (not shown) so that the fusing film 110 is circularly movable.

The halogen lamp 120 is a conventional heater for heating toner on the sheet P by heating a first member 131 (described later) of the nip member 130 and the fusing film 110. The halogen lamp 120 is positioned at an internal space of the fusing film 110 and is spaced away from inner surfaces of the fusing film 110 and the nip member 130 by a predetermined distance.

The nip member 130 is adapted to receive radiant heat radiated from the halogen lamp 120 and is disposed so as to slide-contact the inner surface of the fusing film 110. The nip member 130 (first member 131) transmits the radiant heat radiated from the halogen lamp 120 to toner on a sheet P through the fixing film 110. A detailed structure of the nip member 130 will be described later.

The reflection plate 140 is adapted to reflect radiant heat radiated in the frontward/rearward direction and the upper direction from the halogen lamp 120 toward the nip member 130 (first member 131). The reflection plate 140 is positioned within the fusing film 110 and surrounds the halogen lamp 120, with a predetermined distance therefrom.

Thus, radiant heat radiated from the halogen lamp 120 can be efficiently concentrated onto the nip member 130 (the first member 131) to promptly heat the nip member 130 and the fusing film 110.

The reflection plate 140 has a U-shape in cross-section and is made from a material such as aluminum having high reflection ratio regarding infrared ray and far infrared ray. Specifically, the reflection plate 140 has a U-shaped reflection portion 141 and a flange portion 142 extending from each end portion of the reflection portion 141 in the front-rear direction. A mirror surface finishing is available on the surface of the aluminum reflection plate 140 for specular reflection in order to enhance heat reflection ratio.

The pressure roller 150 is positioned below the nip member 130 (the first member 131) and nips the fusing film 110 in cooperation with the nip member 130 to provide a nip region N for nipping the sheet P between the pressure roller 150 and the fusing film 110. In order to provide the nip region N, one of the pressure roller 150 and the nip member 130 is biased toward the other by a bias member such as a spring.

The pressure roller 150 is rotationally driven by a drive motor (not shown) disposed in the main frame 2. By the rotation of the pressure roller 150, the fusing film 110 is circularly moved along the nip plate 130 because of a friction force generated therebetween or between the sheet P and the fusing film 110.

A toner image on the sheet P can be thermally fixed thereto by heat and pressure during passage of the sheet P at the nip region N between the pressure roller 150 and the fusing film 110.

The stay 160 is positioned within the fusing film 110 and surrounds the reflection plate 140 to support a second member 132 (described later) of the nip member 130 via the flange portion 142 of the reflection plate 140 against a load applied from the pressure roller 150. Note that when the nip member 130 biases the pressure roller 150, a reaction force of the bias force corresponds to the load.

For fabricating the stay 160, a highly rigid member such as a steel plate is folded into U-shape following the outer surface of the reflection plate 140 (the reflection portion 141).

Thus, the position shift of the reflection plate 140 in the upper-lower direction is restrained by sandwiching the flange portion 142 of the reflection plate 140 between the stay 160 and the nip member 130 (the second member 132). Further, since the flange portion 142 of the reflection plate 140 is supported by the stay 160 having a high rigidity, the rigidity of the reflection part 140 is also held.

The thermistor 170 that is a conventional temperature sensor is disposed inside the fusing film 110 to detect the temperature of the nip member 130 (the first member 131). The detail configuration of the thermistor 170 is described later.

The detection result by the two thermistors 170 is inputted into a controller (not shown) provided at the fixing device 100 or the laser printer 1. The controller controls the temperature of the nip portion N by controlling the output and the ON/OFF of the halogen lamp 120. The detail description of the above control is omitted since the above control is well known.

<Detail Construction of Nip Member>

The nip member 130 mainly includes the plate-like first member 131 that slide-contacts the inner surface of the fusing film 110 and the second member 132 disposed between the first member 131 and the stay 160 (the flange portion 142 of the reflection part 140).

Figure 4:
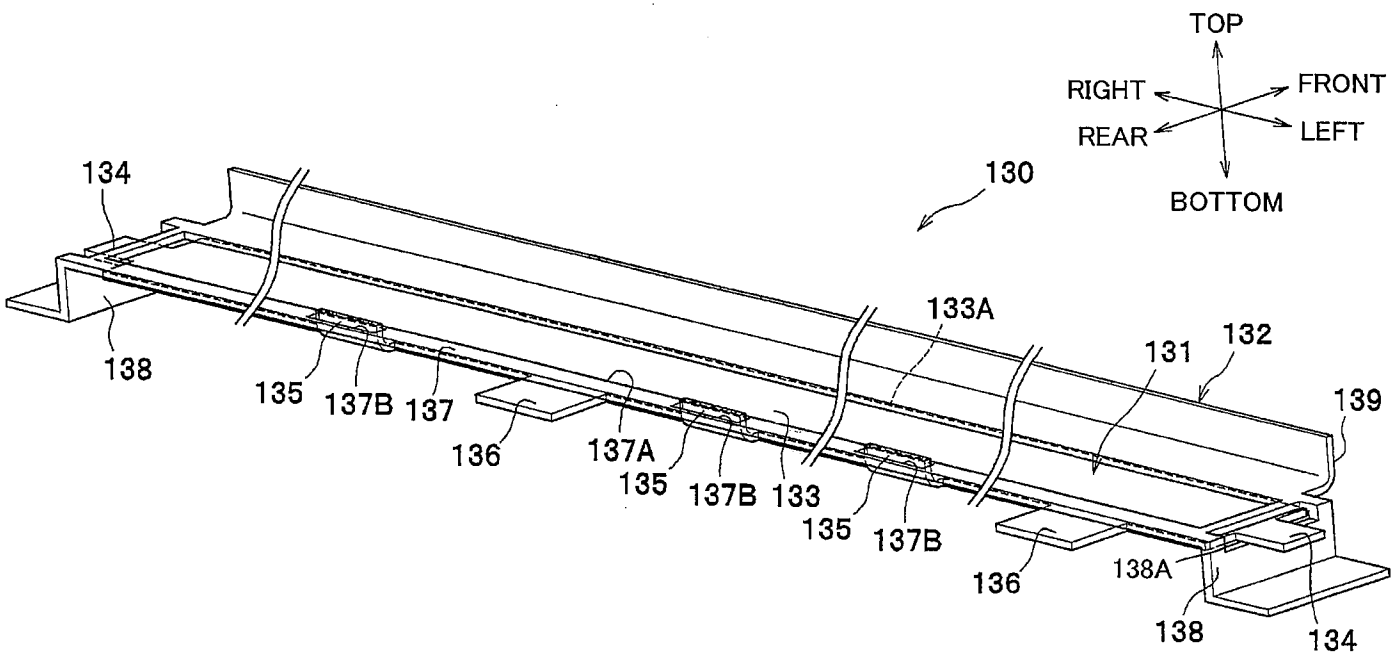
FIG. 4 is a perspective view showing the nip member.

As shown in FIGS. 3 and 4, the first member 131 is formed from an aluminum plate having a heat conductivity higher than the second member 132 formed from a stainless plate as described later. The first member 131 mainly includes a main body 133 having a rectangular shape extending in the left right direction as viewed from the top, a pair of supporting convex parts 134, three engaging convex parts 135, and two protruding parts 136.

The main body 133 has a plate shape having an upper surface opposed to the halogen lamp 120 via an opening 137A of the second member 132 described later (FIG. 2) and a lower surface that slide-contacts the inner surface of the fusing film 110. With this construction, the radiant heat radiated from the halogen lamp 120 is transmitted to the fusing film 110.

The main body 133 has a front side end surface 133A (positioned at an upstream side in the rotational direction of the fusing film 110) extending in the left-right direction (the axis direction of the fusing film 110). A portion that causes an interference with the inner surface of the fusing film 110 rotating does not exist on the front side end surface 133A of the main body 133. Therefore, the fusing film 110 can rotate successfully, thereby it being restrained that the inner surface of the fusing film 110 is worn and damaged.

Note that in order to effectively absorb the radiant heat radiated from the halogen lamp 120, the upper surface of the main body 133 may be coated with black or a heat absorbing member.

Each of the pair of supporting convex parts 134 has a plate shape. One supporting convex part 134 extends from one end of the main body 133 in the left-right direction toward the outside of the main body 133, while the other supporting convex part 134 extends from the other end of the main body 133 in the left-right direction toward the outside of the main body 133. The pair of supporting convex parts 134 is supported by a pair of supporting parts 138 described later, respectively.

The three engaging convex parts 135 extend, upward, from the rear edge of the main body 133 (the downstream side in the rotational direction of the fusing film 110) within a width W (FIG. 5) over which the main body 133 slide-contacts the inner surface of the fusing film 110 in the left-right direction. For fabricating each engaging convex part 135, a plate protruding from the rear edge of the main body 133 is folded into L-shape in the upper direction (FIGS. 2 and 3).

Each oh the two protruding parts 136 has a plate shape protruding from the rear edge of the main body 133 rearward. The two thermistors 170 are disposed inside the fusing film 110 so as to oppose the upper surfaces of the two protruding parts 136, respectively, to detect the temperature of the two protruding parts 136, that is, the temperature of the nip member 130 (the first member 131). Note that a temperature detecting surface of the thermistor 170 may contact the protruding part 136 or may not contact the protruding part 136 (may be spaced away from the protruding part 136 by a predetermined distance).

The second member 132 is formed from a folded stainless plate having a rigidity higher than the first member 131 formed from the aluminum. The second member 132 includes a load transmitting part 137, the pair of supporting parts 138, and a guiding part 139.

The load transmitting part 137 has a frame shape extending in the left-right direction as viewed from the upper side, and is disposed so that the lower surface of the load transmitting part 137 contacts the outer circumference of the upper surface of the first member 131 (the main body 133). Further, as shown in FIG. 2, the load transmitting part 137 is sandwiched between the first member 131 and the stay 160 (the flange portion 142 of the reflection plate 140). With this construction, the load that the first member 131 receives from the pressure roller 150 is transmitted to the stay 160 having a high rigidity via the flange portion 142 of the reflection part 140, thereby the durability of the nip member 130 being held.

Returning to FIGS. 3 and 4, the load transmitting part 137 is formed with the opening 137A for transmitting, to the first member 131, radiant heat radiated downward from the halogen lamp 120 and radiant heat reflected downward by the reflection plate 140, and three engaging concave parts 137B.

The opening 137A has a rectangular shape slightly smaller than the outline of the main body 133 of the first member 131. By the opening 137A, a frame is formed on the load transmitting part 137A, and the frame contacts the outer circumference of the upper surface of the main body 133.

Figure 5:
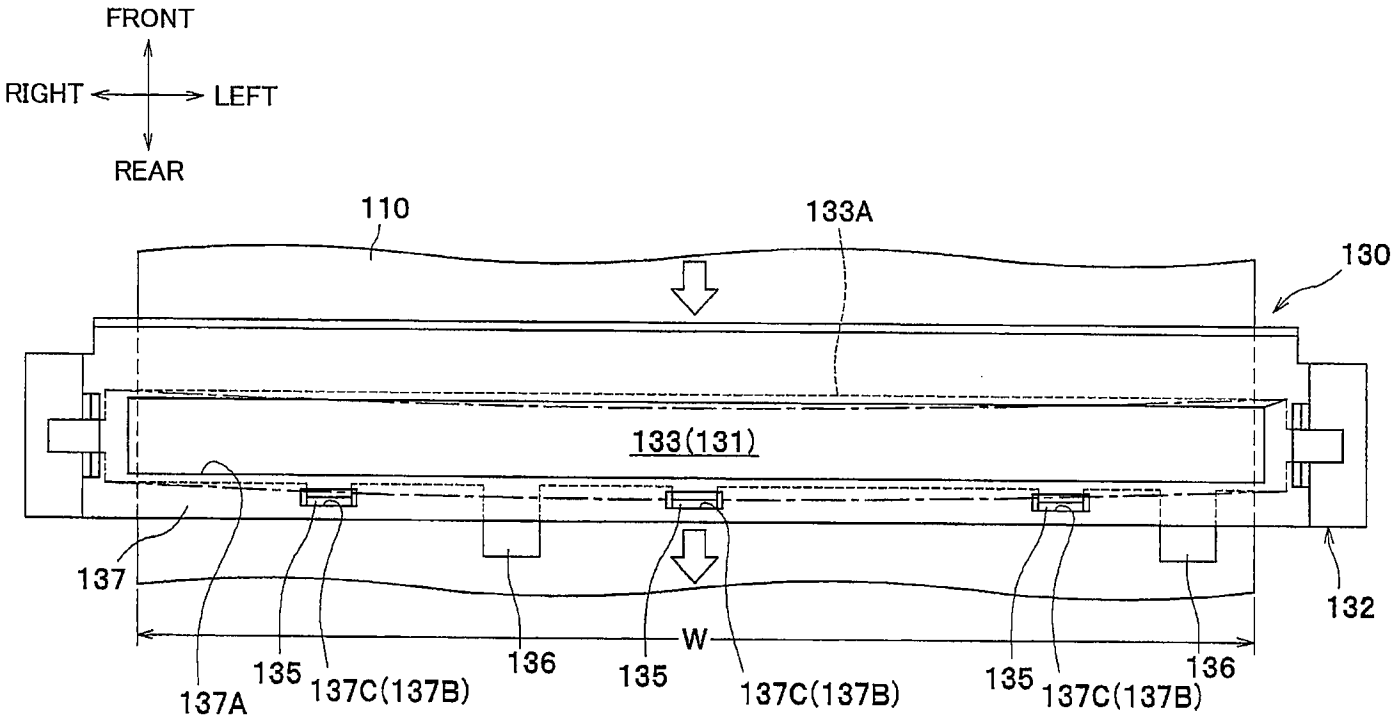
FIG. 5 is a view showing the nip member and a fusing film as viewed from a top.

The three engaging concave parts 137B are formed at positions corresponding to the three engaging convex parts 135 of the first member 131, respectively, so as to engage the three engaging convex parts 135, respectively, when the second member 132 is mounted on the first member 131. Further, the inner surface of each concave part 137B at the rear side of serves as a supporting surface 137C (FIG. 5). When a friction force is applied to the first member 131 from the front to the rear in accordance with the rotation of the fusing film 110, each convex part 135 abuts the corresponding supporting surface 137C.

The pair of supporting parts 138 extends downward from both sides of the load transmitting part 137 in the left-right direction, respectively, and is opposed to one another in the left-right direction. Further, each supporting part 138 is formed with an opening 138A engaged with the corresponding supporting convex part 134 of the first member 131. The first member 131 is held by engaging the supporting convex part 134 with the opening 138A.

As shown in FIG. 2, the guiding part 139 has a plate shape protruding upward from the front edge of the load transmitting part 137 to guide the inner surface of the fusing film 110 in the rotational direction of the fusing film 110 at the upstream of the nip region N. For fabricating the guiding part 139, a plate protruding from the rear edge of the main body 133 is folded into L-shape in the upper direction. The folded portion of the guiding part 139 forms an R shape (curved shape) part that slide-contacts the inner surface of the fusing film 110

With this construction of the guiding part 139, the fusing film 110 is smoothly fed to the nip region N defined between the first member 131 and the pressure roller 150. Further, since the guiding part 139 is integrally provided on the second member 132, the construction of the fusing device 100 becomes simple and mounting facility is improved, compared with the construction in which a guiding part is not integrally provided on the second member, that is, the guiding part is provided as a separated member from the second member.

Further, in the present embodiment, a lubricant agent (not shown) is coated between the nip member 130 (the main body 133 and the guiding part 139) and the fusing film 110 to reduce the reflection resistance between the fusing film 110 and the nip member 130. With this construction, the fusing film 110 can be smoothly rotated.

As described above, in the present embodiment, the nip member 130 is constructed of the first member 131 that slide-contacts the inner surface of the fusing film 110 and the second member 132 disposed between the first member 131 and the stay 160 to transmit, to the stay 160, the load applied from pressure roller 150 to the first member 131. Therefore, it becomes possible to reduce the size (the heat capacity) of the first member 131 for transmitting, to the fusing film 110, the radiant heat radiated from the halogen lamp 120 by reducing the thickness of the plate-like first member 131 and the dimension of the first member 131 (the main body 133).

Further, in the present embodiment, the opening 137A for transmitting, to the first member 131, the radiant heat radiated from the halogen lamp 120 is formed on the second member 132. Therefore, it becomes possible to promptly heat the first member 131. Further, in the present embodiment, the first member 131 has a heat conductivity higher than the second member 132 (the second member 132 has a heat conductivity lower than the first member 131). Therefore, it becomes possible to transmit, to the fusing film 110, most part of heat that the first member 131 has received, without releasing the heat to the reflection plate 140 (the flange portion 142) and the stay 160 via the second member 132.

Thus, since the fusing device 100 according to the present embodiment can effectively transmit, to the fusing film 110 (nip portion N), the radiant heat radiated from the halogen lamp 120, the starting time of the fusing device 100 (the time from when image data is inputted into the laser printer 1 to when the image-forming operation is started) is reduced, thereby the speed-up of the laser printer 1 being achieved.

Further, in a fixing unit that adopts the film fixing method, a friction force from the front to the rear is applied to the nip member 130 (the first member 131) when the fusing film 110 rotates. If the fixing unit 100 is not provided with the engaging convex part 135 and the engaging concave part 137B, the first member 131 can be arched (chain line of FIG. 5) when the temperature of the first member 131 can become high due to the radiant heat radiated from the halogen lamp 120.

However, since in the fixing unit 100 according to the present embodiment, the engaging convex part 135 abuts the supporting surface 137C of the engaging concave part 137B when the fusing film 110 rotates, it is restrained that the first member 131 deforms.

Further, a greater tension is applied to the fusing film 110 at the upstream side of the nip portion N than the downstream side. Therefore, if the engaging convex part 135 is formed at the front end of the main body 133, the inner surface of the fusing film 110 can be partially worn by strongly slide-contacting the engaging convex part 135.

However, in the present embodiment, the engaging convex part 135 is formed at the rear end (positioned at the downstream side in the rotational direction of the fusing film 110) of the main body 133. Therefore, the engaging convex part 135 can slide-contacts the inner surface of the fusing film 110 with less tension, thereby it being restrained that the inner surface of the fusing film 110 is partially worn.

Further, the tension applied to the fusing film 110 is different between a portion of the fusing film 110 that slide-contacts the engaging convex part 135 and a portion of the fusing film 110 that does not slide-contacts the engaging convex part 135. If the engaging convex part 135 is formed at the front end of the nip portion N where a greater tension is applied to the fusing film 110, the difference of the tension becomes greater. As the result, the fusing film 110 can be folded. However, in the present embodiment, the engaging convex part 135 is formed at the rear end of the nip portion N where the tension becomes substantially even between a portion of the fusing film 110 that slide-contacts the engaging convex part 135 and a portion of the fusing film 110 that does not slide-contacts the engaging convex part 135. Therefore, it can be restrained that the fusing film 110 is folded.

Further, if the engaging convex part 135 is formed at the front end of the nip portion N in the main body 133, much lubricant collects on the engaging convex part 135 than the other part of the main body 133, thereby the amount of the lubricant inserted between the fusing film 110 and the first member 131 becoming uneven between a portion of the fusing film 110 that slide-contacts the engaging convex part 135 and a portion of the fusing film 110 that does not slide-contacts the engaging convex part 135. However, in the present embodiment, the engaging convex part 135 is formed at the rear end of the nip portion N. Therefore, it can be restrained that the amount of the lubricant inserted between the fusing film 110 and the first member 131 becomes uneven between a portion of the fusing film 110 that slide-contacts the engaging convex part 135 and a portion of the fusing film 110 that does not slide-contacts the engaging convex part 135.

Further, in the present embodiment, the front end of the first member 131 (the front side 133A of the main body 133) has a plate shape extending in the left-right direction. Therefore, the amount of the lubricant inserted between the fusing film 110 and the first member 131 can become even between a portion of the fusing film 110 that slide-contacts the engaging convex part 135 and a portion of the fusing film 110 that does not slide-contacts the engaging convex part 135.

Further, in the present embodiment, the first member 131 is provided with the protruding part 136 opposed to the thermistor 170. Therefore, it becomes possible to accurately detect the temperature of the nip member 130 (the first member 131), thereby accurately controlling the temperature of the nip portion N.

Further, in the present embodiment, the protruding part 136 is also disposed at the rear end of the main body 133 as the engaging convex part 135. Therefore, it can be restrained that the inner surface of the fusing film 110 is partially worn, the amount of the lubricant inserted between the fusing film 110 and the first member 131 becomes uneven between a portion of the fusing film 110 that slide-contacts the protruding part 136 and a portion of the fusing film 110 that does not slide-contacts the protruding part 136, and the fusing film 110 is folded.

While the invention has been described in detail with reference to the embodiment thereof, it would be apparent to those skilled in the art that various changes and modifications may be made therein without departing from the spirit of the invention.

For example, the first member 131 may be made from an aluminum alloy, a copper, or a copper alloy, instead of the aluminum. Note that it is preferable that the heat conductivity becomes greater in the order of the second member, the tubular flexible fusing member, and the first member.

Further, a guide member that is not integrally provided on the second member 132 may be provided on the fixing unit 100, instead of the guide member 139.

Further, the front side end surface 133A of the main body 135 may has a plate shape extending in the left-right direction that is slightly longer than a width W (FIG. 5) of the fusing film 110.

Further, a thermostat may be used as a temperature detecting unit, instead of the thermistor 170, for example. Further, more than two temperature detecting units may be provided on the fixing unit 100. In this case, both the thermistor and the thermostat may be provided on the fixing unit 100.

Further, the protruding part 136 may not be provided if the temperature detecting unit is disposed outside the tubular flexible fusing member, for example.

Further, other members may be used instead of the engaging convex part 135 and the engaging concave part 137B if the same function and effect are obtained.

For example, a convex part that is not penetrated may be used instead of the engaging convex part 135.

Further, the flange portion 160 may not be provided on the fixing unit 100. In this case, the second member directly contacts the stay.

Further, the reflection part 140 and the stay 160 may be integrally formed. For example, a reflection part can be formed at the inner surface of a stay. In this case, the stay includes both a function for receiving a load from a backup member and supporting the nip member 130 and a function of the reflection part 140.

Further, a belt-like pressure member may be used instead of the pressure roller 150, for example.

Further, an infrared heater or a carbon heater may be used instead of the halogen lamp 120, for example.

Further, an LED printer that performs an exposure with an LED, a copier, or a multifunction peripheral may be used instead of the laser printer 1, for example. Further, an image-forming device that forms a color image may be used as the laser printer 1, for example.

What is claimed is:

1. A fixing device comprising:

a flexible tubular member having an outer peripheral surface, an inner peripheral surface defining an internal space, and an axis defining an axial direction, the tubular member being configured to circularly move in a rotational direction around the axis;

a heater disposed in the internal space to radiate radiant heat;

a nip member that is in contact with the inner peripheral surface to transmit the radiant heat to the tubular member;

a reflection plate configured to reflect the radiant heat from the heater toward the nip member;

a backup member that is in contact with the outer peripheral surface to form a nip region between the backup member and the tubular member, the backup member applying a load to the nip member; and a stay disposed in the internal space to surround the reflection plate and configured to support the nip member against the load, wherein the nip member comprises:

a first member that is in contact with the inner peripheral surface; and a second member disposed between the first member and the stay to transmit the load to the stay, wherein the reflection plate has a flange portion sandwiched between the stay and the second member, wherein the first member has a heat conductivity higher than the second member, and wherein the second member is formed with an opening for transmitting the radiant heat to the first member.

2. The fixing device according to claim 1, wherein the first member has a first end portion that is positioned at a downstream side in the rotational direction and is in contact with the inner peripheral surface over a width in the axial direction, and a convex part protruding from at least one part of the first end portion, and wherein the second member is formed with a concaved part engaged with the convex part to prevent the first member from deforming due to contact with the tubular member when the tubular member is circularly moving.

3. The fixing device according to claim 1, further comprising a temperature detecting member disposed in the internal space to detect a temperature of the nip member, wherein the first member has an end portion positioned at a downstream side in the rotational direction, and a protruding part protruding from the end portion, the temperature detecting member facing the protruding part to detect the temperature of the nip member.

4. The fixing device according to claim 1, wherein the first member has an end portion positioned at an upstream side in the rotational direction, the end portion having a flat shape that extends in the axial direction and is in contact with the inner peripheral surface over a width in the axial direction.

5. The fixing device according to claim 1, wherein the second member has a guide member at an upstream side of the nip member in the rotational direction to guide the inner peripheral surface.

6. The fixing device according to claim 1, wherein the first member is formed from an aluminum or an aluminum alloy, and the second member is formed from a stainless plate.

* * * * *